US011950678B2

(12) United States Patent
Shimotani

(10) Patent No.: US 11,950,678 B2
(45) Date of Patent: Apr. 9, 2024

(54) APPLICATION CONTAINER

(71) Applicant: YOSHINO KOGYOSHO CO., LTD., Tokyo (JP)

(72) Inventor: Kazuhiko Shimotani, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 14 days.

(21) Appl. No.: 17/788,851

(22) PCT Filed: Dec. 22, 2020

(86) PCT No.: PCT/JP2020/048037
§ 371 (c)(1),
(2) Date: Jun. 24, 2022

(87) PCT Pub. No.: WO2021/132280
PCT Pub. Date: Jul. 1, 2021

(65) Prior Publication Data

US 2023/0049399 A1 Feb. 16, 2023

(30) Foreign Application Priority Data

Dec. 27, 2019 (JP) ..... 2019-239267

(51) Int. Cl.
*A45D 34/04* (2006.01)
*B65D 41/04* (2006.01)
*B65D 47/42* (2006.01)

(52) U.S. Cl.
CPC ..... *A45D 34/041* (2013.01); *B65D 41/04* (2013.01); *B65D 47/42* (2013.01)

(58) Field of Classification Search
CPC ..... A45D 34/041; A45D 40/261
(Continued)

(56) References Cited

U.S. PATENT DOCUMENTS 2,998,616 A * 9/1961 Gentile ..... A45D 34/041 401/213
3,095,598 A * 7/1963 Gonnella ..... A61M 35/003 401/214

(Continued)

FOREIGN PATENT DOCUMENTS

CN 203652309 U 6/2014
CN 208856148 U 5/2019

(Continued)

OTHER PUBLICATIONS

Mar. 23, 2021 International Search Report issued in International Patent Application No. PCT/JP2020/048037.

(Continued)

*Primary Examiner* — David P Angwin
*Assistant Examiner* — Bradley S Oliver
(74) *Attorney, Agent, or Firm* — Oliff PLC

(57) ABSTRACT

An application container includes a container main body, an inner plug, and a cap detachably mounted on a container body, the inner plug includes a holding cylinder section, and an application ball, the holding cylinder section has a holding cylinder main body, and a soft seal part, the soft seal part has an annular shape extending around a center axis and is elastically deformable, and the application ball is pushed downward by the cap and pushed into the soft seal part as the cap is mounted on the container body.

5 Claims, 2 Drawing Sheets

(58) Field of Classification Search
USPC ..... 401/213–214
See application file for complete search history.

(56) References Cited

U.S. PATENT DOCUMENTS

| | | | | |
|---|---|---|---|---|
| 3,174,175 | A | 3/1965 | Frank | |
| 4,221,494 | A * | 9/1980 | Kachur | A45D 34/041 401/214 |
| 2010/0180543 | A1 * | 7/2010 | Arcuri Neto | B65D 47/42 53/203 |

FOREIGN PATENT DOCUMENTS

| | | | |
|---|---|---|---|
| JP | 43-006748 | B1 | 3/1968 |
| JP | S-4721492 | U | 11/1972 |
| JP | S-4722787 | U | 11/1972 |
| JP | 49-002755 | U1 | 1/1974 |
| JP | S49-028110 | Y1 | 7/1974 |
| JP | S49-96359 | U | 8/1974 |
| JP | S50-019351 | Y1 | 6/1975 |
| JP | S53-529 | B2 | 1/1978 |
| JP | H06-057465 | U | 8/1994 |
| JP | 2013-154948 | A | 8/2013 |
| JP | 2013-249098 | A | 12/2013 |
| JP | 2018-79967 | A | 5/2018 |
| JP | 2018-104072 | A | 7/2018 |
| KR | 20-2017-0000700 | U | 2/2017 |

OTHER PUBLICATIONS

Apr. 22, 2023 Office Action issued in Chinese Patent Application No. 202080089677.0.
Apr. 25, 2023 Office Action issued in Japanese Patent Application No. 2019-239267.
Jan. 8, 2024 European Search Report issued in European Patent Application No. 20905593.8.

* cited by examiner

APPLICATION CONTAINER

TECHNICAL FIELD

The present invention relates to an application container.

Priority is claimed on Japanese Patent Application No. 2019-239267, filed Dec. 27, 2019, the content of which is incorporated herein by reference.

BACKGROUND ART

In the related art, for example, as disclosed in Patent Document 1, a so-called roll-on type application container including an application ball is known.

The application container includes a container main body in which contents are accommodated, an inner plug mounted in a mouth part of the container main body, and a cap configured to cover the inner plug from above and screwed onto the mouth part detachably. When the cap is screwed onto the mouth part, the application ball of the inner plug is pushed against an inner annular seal part, and communication between the inside and the outside of the container main body passing through the inner plug is blocked.

CITATION LIST

Patent Document

[Patent Document 1]
Japanese Unexamined Patent Application, First Publication No. 2013-454948

SUMMARY OF INVENTION

Technical Problem

In the application container in the related art, since a phenomenon in which the inner annular seal part is gradually plastically deformed while the cap is repeatedly attached and detached, i.e., a phenomenon called "setting," occurs, and sealability when the cap is mounted may become unstable.

In the case of a configuration in which the cap is screwed onto the mouth part, the cap needs to be screwed on by a greater amount to secure sealability according to a level of the "setting" phenomenon. However, when the cap is not screwed on by a sufficiently greater amount, or when the cap is mounted on the mouth part through undercut fitting for the purpose of, for example, provision of a clean appearance for a product, an increase in operability, or the like, sealability may become unstable over time.

In consideration of the above-mentioned circumstances, the present invention is directed to provide an application container in which sealability in mounting of a cap can be stably increased.

Solution to Problem

An application container of a first aspect of the present invention includes a container main body in which contents are accommodated; an inner plug mounted on a. mouth part of the container main body; and a cap configured to cover the inner plug from above and detachably mounted on a container body including the container main body and the inner plug, the inner plug includes: a holding cylinder section having a communication port configured to bring the inside and the outside of the container main body in communication with each other; and an application ball rotatably held in the holding cylinder section and a portion of which is exposed from above through the holding cylinder section, the holding cylinder section has: a holding cylinder main body configured to come into contact with the application ball from an outer side and an upper side in a radial direction; and a soft seal part held by the holding cylinder main body, formed of a material softer than the holding cylinder main body, and configured to come into contact with the application ball from below, the soft seal part has an annular shape extending around a center axis of the holding cylinder main body and is elastically deformable, and the application ball is pushed downward by the cap and pushed into the soft seal part as the cap is mounted on the container body.

According to the application container of the first aspect of the present invention, when the cap is mounted on the container body, the application ball is pushed downward by the cap and pressed against the soft seal part. Accordingly, communication of the communication port passing between the application ball and the soft seal part is blocked, and leakage of the contents from the inside to the outside of the container main body is suppressed.

According to the application container of the first aspect of the present invention, since the soft seal part is formed of a soft material such as an elastomer, rubber, or the like, that is elastically deformable, even when the cap is repeatedly attached and detached, the soft seal part is less likely to settle, and the so-called "setting" phenomenon is less likely to occur. Accordingly, seal ability in mounting of the cap is stably increased for a long period of time.

In the above-mentioned application container of the first aspect, the application container according to a second aspect of the present invention includes a first locking section protruding outward from the container body in the radial direction; and a second locking section protruding inward from an inner circumferential surface of the cap in the radial direction and configured to come into contact with the first locking section to climb over the first locking section from below.

According to the application container of the second aspect of the present invention, the cap is detachably mounted on the container body through undercut fitting. In the present invention, since the soft seal part is less likely to be plastically deformed and the "setting" phenomenon is less likely to occur, even when the cap is mounted through undercut fitting, the scalability between the application ball and the soft seal part is appropriately maintained for a long period of time. Since the cap is attached and detached through undercut fitting, it is possible to provide a clean appearance for the product or increase the operability.

In the above-mentioned application container of the first or second aspect, according to the application container of a third aspect of the present invention, the holding cylinder main body and the soft seal part are formed integrally.

According to the application container of the third aspect of the present invention, the holding cylinder main body and the soft seal part are formed integrally through, for example, insert molding, two-color molding, or the like. For example, in comparison with the case in which the holding cylinder main body and the soft seal part are formed separately, according to the configuration, the configuration of the holding cylinder section can be simplified, the function of the holding cylinder section can be stabilized, the assembly process can be reduced to suppress complication of a manufacturing process, and manufacturing cost can be reduced.

In the application container of the first to third aspect, according to the application container of a fourth aspect of the present invention, the soft seal part is exposed through a surface of the holding cylinder section directed downward.

According to the application container of the fourth aspect of the present invention, since the soft seal part is exposed through the surface of the holding cylinder section directed downward, the soft seal part can be injection-molded from below the inner plug. It is possible to suppress restrictions on the molding of the soft seal part, facilitate the molding, and increase a degree of freedom of the molding.

Advantageous Effects of Invention

According to the application container of the present invention, it is possible to stably increase sealability in mounting of the cap.

DESCRIPTION OF EMBODIMENTS

Hereinafter, an application container 10 of an embodiment of the present invention will be described with reference to the accompanying drawings.

Figure 1:
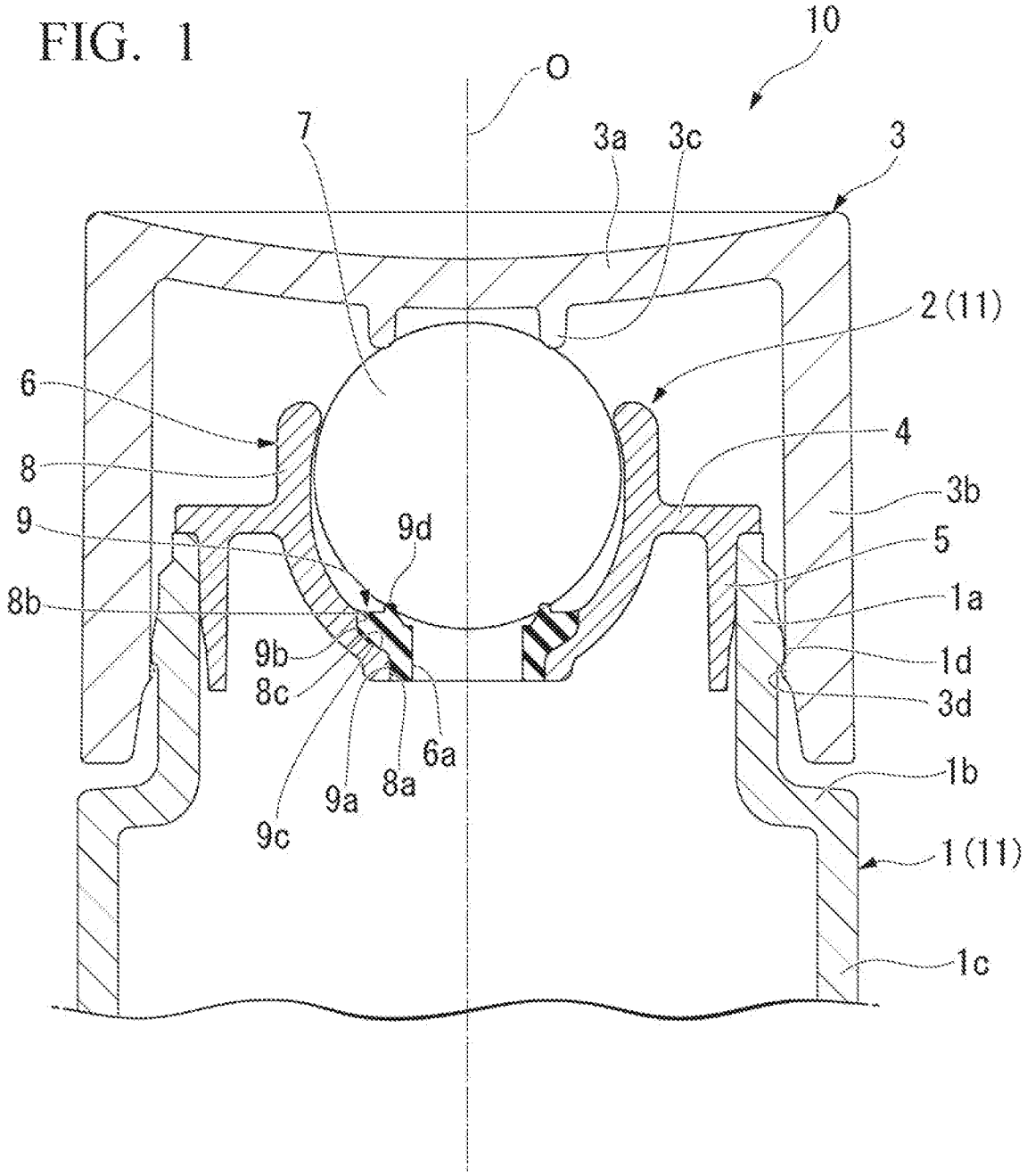
FIG. 1 is a longitudinal cross-sectional showing a major part of an application container of an embodiment.

As shown in FIG. 1, the application container 10 of the embodiment includes a container body 11 including a container main body 1 and an inner plug 2, and a cap 3 detachably mounted on the container body 11. That is, the application container 10 includes the container main body 1, the inner plug 2, and the cap 3. The container main body 1 is formed in a cylindrical shape provided with a bottom, and contents are accommodated therein. The inner plug 2 is mounted on a mouth part 1*a* of the container main body 1. The cap 3 is formed in a cylindrical shape provided with a top. In the embodiment, the cap 3 is detachably mounted on the mouth part 1*a*. The container main body 1 and the cap 3 are formed of, for example, a resin. The inner plug 2 has, for example, a member formed of a resin, and a member formed of a ceramic. The contents are, for example, a liquid.

The mouth part 1*a* and the cap 3 of the container main body 1 are disposed coaxially using a center axis O as a common axis.

In the embodiment, a direction in which the center axis O extends, i.e., a direction parallel to the center axis O, is referred to as an upward/downward direction. The upward/downward direction may also be called an axial direction. In the upward/downward direction, the mouth part 1*a* of the container main body 1 and a top wall 3*a* of the cap 3 are disposed at different positions. In the upward/downward direction, a direction from the mouth part 1*a* toward the top wall 3*a* is referred to as an upward direction, and a direction from the top wall 3*a* toward the mouth part 1*a* is referred to as a downward direction.

When seen in a plan view from the upward/downward direction, a direction perpendicular to the center axis O is referred to as a radial direction. In the radial direction, a direction toward the center axis O is referred to as inward in the radial direction, and a direction away from the center axis O is referred to as outward in the radial direction.

A direction around the center axis O is referred to as a circumferential direction.

Figure 2:
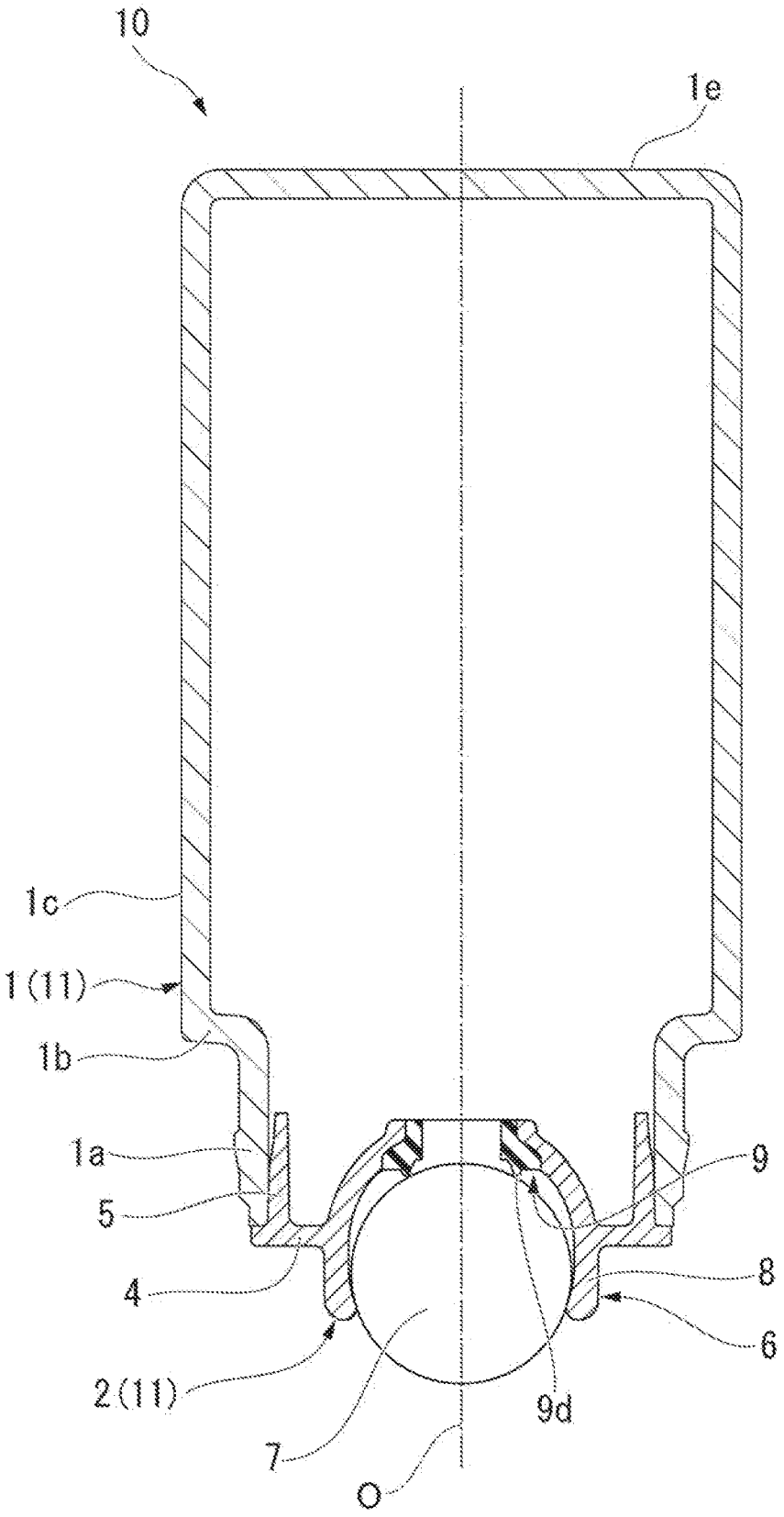
FIG. 2 is a longitudinal cross-sectional view showing an application container of the embodiment, and expressing an inverted posture of the application container, i.e., a posture of the application container in use.

As shown in FIGS. 1 and 2, the container main body 1 has the mouth part 1*a*, a shoulder section 1*b*, a drum section 1*c*, a bottom section 1*e*, and a first locking section 1*d*. That is, the application container 10 includes the first locking section 1*d*.

The mouth part 1*a* is formed in a cylindrical shape about the center axis O and extends in the upward/downward direction.

The shoulder section 1*b* is connected to a lower end portion of the mouth part 1*a*. The shoulder section 1*b* has a flange shape expanding outward from the lower end portion of the mouth part 1*a* in the radial direction.

The drum section 1*c* is connected to an outer end portion of the shoulder section 1*b* in the radial direction. The drum section 1*c* has a cylindrical shape extending in the upward/downward direction.

The bottom section 1*e* is connected to a lower end portion of the drum section 1*c*. The bottom section 1*e* has a disk shape expanding in a direction perpendicular to the center axis O.

As shown in FIG. 1, the first locking section 1*d* protrudes outward from the container body 11 in the radial direction. In the embodiment, the first locking section 1*d* protrudes outward from an outer circumferential surface of the mouth part 1*a* in the radial direction. The first locking section 1*d* has a rib shape extending on the outer circumferential surface of the mouth part 1*a* in the circumferential direction. The first locking section 1*d* may extend on the entire circumference of the outer circumferential surface of the mouth part 1*a* in the circumferential direction, or the plurality of first locking sections 1*d* may be provided at intervals in the circumferential direction.

The inner plug 2 has a flange section 4, a seal cylinder section 5, a holding cylinder section 6, and an application ball 7. The flange section 4 and the seal cylinder section 5 are formed of a resin such as low density polyethylene or the like. The application ball 7 is formed of, for example, a ceramic.

The flange section 4 has an annular plate shape about the center axis O, and expands in a direction perpendicular to the center axis O. An outer circumferential section of the lower surface of the flange section 4 comes into contact with an upper end opening edge of the mouth part 1*a*.

The seal cylinder section 5 has a cylindrical shape about the center axis O, and extends in the upward/downward direction. The seal cylinder section 5 is hung on the lower surface of the flange section 4, and fitted into the mouth part 1*a*.

The holding cylinder section 6 has a cylindrical shape about the center axis O, and extends in the upward/downward direction. The holding cylinder section 6 has an intermediate portion located between an upper end portion and a lower end portion of the outer circumferential surface of the holding cylinder section 6 and connected to an inner circumferential section of the flange section 4. The holding cylinder section 6 has a minimum inner diameter at the lower end portion and a maximum inner diameter at an intermediate portion located between the upper end portion and the lower end portion.

The holding cylinder section 6 has a communication port 6*a* configured to bring the inside and the outside of the container main body 1 in communication with each other. The communication port 6*a* is constituted by an inner circumferential surface of the holding cylinder section 6, and opens upward and downward from the holding cylinder section 6.

The configuration of the holding cylinder section 6 other than the above-mentioned configuration will be described below separately.

The application ball 7 has a spherical shape about the center axis O. The application ball 7 is rotatably held in the holding cylinder section 6. The upper end portion of the application ball 7 protrudes upward from the upper end opening portion of the holding cylinder section 6. That is, the application ball 7 has a portion exposed from above the holding cylinder section 6. A diameter of the application ball 7, i.e., an outer diameter, is greater than the inner diameter of the lower end opening portion of the holding cylinder section 6. The outer diameter of the application ball 7 is greater than the inner diameter of the upper end opening portion of the holding cylinder section 6. The application ball 7 is inserted into the holding cylinder section 6 by, for example, expanding the upper end opening portion of the holding cylinder section 6 through elastic deformation.

The holding cylinder section 6 has a holding cylinder main body 8 and a soft seal part 9.

The holding cylinder main body 8 is formed of a resin such as low density polyethylene or the like, and at least the upper end opening portion is elastically deformable. The holding cylinder main body 8 has a cylindrical shape about the center axis O, and extends in the upward/downward direction. That is, the center axis O is a center axis of the holding cylinder main body 8. The lower end surface of the holding cylinder main body 8 configures an outer circumferential section of the surface of the holding cylinder section 6 directed downward. That is, the holding cylinder main body 8 is exposed through the surface of the holding cylinder section 6 directed downward.

An upper portion of the inner circumferential surface of the holding cylinder main body 8 faces the outer circumferential surface of the application ball 7 with a gap from an outer side and an upper side in the radial direction or comes into contact therewith. The holding cylinder main body 8 can come into contact with the application ball 7 from an outer side and an upper side in the radial direction.

The holding cylinder main body 8 has a first inner circumferential section 8*a*, a second inner circumferential section 8*b*, and a third inner circumferential section 8*c*. The first inner circumferential section 8*a*, the second inner circumferential section 8*b*, and the third inner circumferential section 8*c* are disposed at a lower side portion of the inner circumferential surface of the holding cylinder main body 8. Each of the first inner circumferential section 8*a*, the second inner circumferential section 8*b*, and the third inner circumferential section 8*c* has an annular shape about the center axis O.

The first inner circumferential section 8*a* is located on a lower end opening portion of the inner circumferential surface of the holding cylinder main body 8. That is, the first inner circumferential section 8*a* is a portion located at the lowermost side of the inner circumferential surface of the holding cylinder main body 8. The first inner circumferential section 8*a* is directed inward in the radial direction, and extends in the circumferential direction. The inner diameter of the first inner circumferential section 8*a* is smallest in the holding cylinder main body 8.

The second inner circumferential section 8*b* is a portion of the inner circumferential surface of the holding cylinder main body 8 located above the first inner circumferential section 8*a*. The second inner circumferential section 8*b* is directed inward in the radial direction, and extends in the circumferential direction. The inner diameter of the second inner circumferential section 8*b* is greater than the inner diameter of the first inner circumferential section 8*a*.

The third inner circumferential section 8*c* is a portion located between the first inner circumferential section 8*a* and the second inner circumferential section 8*b* of the inner circumferential surface of the holding cylinder main body 8. The third inner circumferential section 8*c* connects the upper end portion of the first inner circumferential section 8*a* and the lower end portion of the second inner circumferential section 8*b*. The third inner circumferential section 8*c* is directed upward and inward in the radial direction, and extends in the circumferential direction. In the embodiment, the third inner circumferential section 8*c* has a tapered surface shape with a diameter that is gradually reduced downward.

The soft seal part 9 is formed of, for example, an elastomer, rubber, or the like, which is softer than the material of the holding cylinder main body 8. The soft, seal part 9 has an annular shape extending around the center axis O, which is elastically deformable. The soft seal part 9 has a cylindrical shape about the center axis O, and extends in the upward/downward direction. The soft seal part 9 is disposed in the lower end portion of the holding cylinder main body 8, and held by the holding cylinder main body 8. The outer circumferential surface of the soft seal part 9 comes into close contact with the inner circumferential surface of the holding cylinder main body 8 with no gap. In the embodiment, the holding cylinder main body 8 and the soft seal part 9 are formed integrally through, for example, insert molding, two-color molding, or the like. The lower end surface of the soft seal part 9 configures an inner circumferential section in a surface of the holding cylinder section 6 directed downward. That is, the soft seal part 9 is exposed through the surface of the holding cylinder section 6 directed downward.

The upper end portion of the soft seal part 9 faces the outer circumferential surface of the application ball 7 with a gap from below or comes into contact therewith. The soft seal part 9 can come into contact with the application ball 7 from below.

The soft seal part 9 has a first outer circumferential section 9*a*, a second outer circumferential section 9*b*, a third outer circumferential section 9*c*, and a seal protrusion 9*d*. Each of the first outer circumferential section 9*a*, the second outer circumferential section 9*b*, the third outer circumferential section 9*c*, and the seal protrusion 9*d* has an annular shape about the center axis O.

The first outer circumferential section 9*a* is located at a lower end portion of the outer circumferential surface of the soft seal part 9. The first outer circumferential section 9*a* is directed outward in the radial direction, and extends in the circumferential direction. The outer diameter of the first outer circumferential section 9*a* is smallest in the soft seal part 9. The first outer circumferential section 9*a* comes into close contact with the first inner circumferential section 8*a* of the holding cylinder main body 8.

The second outer circumferential section 9*b* is a portion of the outer circumferential surface of the soft seal part 9 located above the first outer circumferential section 9*a*. The second outer circumferential section 9*b* is located on an upper end portion in the outer circumferential surface of the soft seal part 9. The second outer circumferential section 9*b* is directed outward in the radial direction, and extends in the circumferential direction. The outer diameter of the second outer circumferential section 9*b* is greater than the outer diameter of the first outer circumferential section 9*a*. The outer diameter of the second outer circumferential section 9*b* is greatest in the soft seal part 9. The second outer circumferential section 9*b* comes into close contact with the second inner circumferential section 8*b* of the holding cylinder main body 8.

The third outer circumferential section 9*c* is a portion of the outer circumferential surface of the soft seal part 9 located between the first outer circumferential section 9*a* and the second outer circumferential section 9*b*. The third outer circumferential section 9*c* connects the upper end portion of the first outer circumferential section 9*a* and the lower end portion of the second outer circumferential section 9*b*. The third outer circumferential section 9*c* is directed downward and outward in the radial direction, and extends in the circumferential direction. In the embodiment, the third outer circumferential section 9*c* has a tapered surface shape with a diameter that is gradually reduced downward. The third outer circumferential section 9*c* comes into contact with the third inner circumferential section 8*c* of the holding cylinder main body 8. The third inner circumferential section 8*c* comes into contact with the third outer circumferential section 9*c* from below.

The seal protrusion 9*d* protrudes upward from the upper end surface of the soil seal part 9. The seal protrusion 9*d* has a rib shape extending in the circumferential direction. The seal protrusion 9*d* can conic into contact with the lower end portion of the outer circumferential surface of the application ball 7 from below. The seal protrusion 9*d* comes into water-tight contact with the application ball 7 or faces the application ball 7 with a gap throughout the entire circumference in the circumferential direction. A thickness of the seal protrusion 9*d* in the radial direction is smaller than the thickness of the portion of the soft seal part 9 in the radial direction other than the seal protrusion 9*d*.

The cap 3 covers the inner plug 2 from above. The cap 3 has the top wall 3*a*, a circumferential wall 3*b*, a pushing cylinder 3*c*, and second locking sections 3*d*. That is, the application container 10 includes the second locking sections 3*d*.

The top wall 3*a* has a disk shape about the center axis O, and in the example shown, a disk shape curved to extend upward from above the center axis O toward an outer side in the radial direction.

The circumferential wall 3*b* is connected to an outer end portion of the top wall 3*a* in the radial direction. The circumferential wall 3*b* has a cylindrical shape extending in the upward/downward direction. The lower end opening edge of the circumferential wall 3*b* faces the shoulder section 1*b* of the container main body 1 with a gap in the upward/downward direction.

The pushing cylinder 3*c* has a cylindrical shape about the center axis O, and extends in the upward/downward direction. The pushing cylinder 3*c* is hung on the lower surface of the top wall 3*a*. The lower end opening portion of the pushing cylinder 3*c* comes into contact with the upper end portion of the outer circumferential surface of the application bail 7 from above.

The application ball 7 is pressed against the seal protrusion 9*d* while being pushed downward by the pushing cylinder 3*c*. That is, the application ball 7 is pushed downward by the cap 3 and pushed into the soft seal part 9 as the cap 3 is mounted on the mouth part 1*a*, i.e., the container body 11.

In addition, when the cap 3 is removed from the mouth part 1*a*, i.e., the container body 11, a state in which the application ball 7 is pushed into the soft seal part 9 is released, and the application ball 7 is separable upward from the soft seal part 9.

The second locking sections 3*d* protrude inward from the inner circumferential surface of the circumferential wall 3*b*, i.e., the inner circumferential surface of the cap 3 in the radial direction. The second locking sections 3*d* are a plurality of protrusions formed on the inner circumferential surface of the cap 3, which are provided at intervals in the circumferential direction. In the embodiment, three second locking sections 3*d* are provided at equal intervals in the circumferential direction. The second locking sections 3*d* come into contact with the first locking section 1*d* to climb over the first locking section id from below. That is, the second locking sections 3*d* are locked to the first locking section 1*d* through undercut fitting.

Next, an action when contents are applied to a material to be applied (that is not shown) using the application container 10 of the embodiment will be described.

First, as shown in FIG. 1, the cap 3 is removed from the container body 11 of the application container 10 that is at an upright posture. Accordingly, the soft seal part 9 elastically deformed while being pressed downward by the pushing cylinder 3*c* via the application ball 7 is restored and deformed.

As shown in FIG. 2, when the application container 10 is at an inverted posture, the application ball 7 moves in the holding cylinder section 6 upward (i.e., downward in the vertical direction), a gap is formed between the seal protrusion 9*d* and the application ball 7, and the contents can flow through the gap. In addition, at the inverted posture, the application ball 7 comes into close contact with the inner surface of the upper end portion of the holding cylinder main body 8, and the contents are suppressed from outflow of the inside to the outside of the holding cylinder section 6. Then, contents are stored between the holding cylinder main body 8 and the application ball 7.

When the application ball 7 is pressed against the material to be applied (that is not shown), the application ball 7 moves downward in the holding cylinder section 6 (i.e., upward in the vertical direction), the upper end portion inner surface of the holding cylinder main body 8 and the application ball 7 are separated and the seal is opened, the contents accumulated between the holding cylinder main body 8 and the application ball 7 flows to the outside of the holding cylinder section 6, and the contents are applied to the material to be applied.

Further, in a state in which the application ball 7 is pressed against the material to be applied, since the seal state by the seal protrusion 9*d* is maintained as the application ball 7 is pushed into the seal protrusion 9*d*, excessive outflow of the contents (i.e., more than a predetermined amount) is suppressed.

In the application container 10 of the embodiment described above, when the cap 3 is mounted on the container body 11, the application ball 7 is pushed downward by the cap 3, the soft seal part 9 is pressed. Accordingly, communication of the communication port 6*a* passing between the application ball 7 and the soft seal part 9 is blocked, and a leakage of the contents from the inside to the outside of the container main body 1 is suppressed.

According to the embodiment, since the soft seal part 9 is formed of a soft material such as an elastomer, rubber, or the like, that is elastically deformable, even when the cap 3 is repeatedly attached and detached, the soft seal part 9 is less likely to settle, and the so-called "setting" phenomenon is less likely to occur. Accordingly, the sealability when the cap 3 is attached is stably enhanced for a long period of time.

In addition, in the embodiment, the application container 10 includes the first locking section 1*d*, and the second locking sections 3*d* in contact with the first locking section 1*d* to climb over the first locking section 1*d* from below, in other words, the cap 3 is detachably mounted on the container body 11 through undercut fitting. Accordingly, in the embodiment, since the soft seal part 9 is less likely to be plastically deformed and the "setting" phenomenon is less likely to occur, even when the cap 3 is mounted through undercut fitting, the sealability between the application ball 7 and the soft seal part 9 is appropriately maintained over the long term. Since the cap 3 is attached and detached through undercut fitting, it is possible to provide a clean appearance to a product and enhance operability of the product.

In addition, in the embodiment, the holding cylinder main body 8 and the soft seal part 9 are formed integrally. Accordingly, for example, in comparison with the case in which the holding cylinder main body 8 and the soft seal part 9 are formed separately, the configuration of the holding cylinder section 6 can be simplified, the function of the holding cylinder section 6 can be stabilized, the assembly process can be reduced to suppress complication of the manufacturing process, and manufacturing cost can be reduced.

In addition, in the embodiment, the soft seal part 9 is exposed to a surface of the holding cylinder section 6 directed downward. Accordingly, the soft seal part 9 can be injection-molded from below the inner plug 2. For this reason, by suppressing the restriction on the molding of the soft seal part 9, it is possible to facilitate the molding and increase the degree of freedom of the molding.

In addition, in the embodiment, the third inner circumferential section 8*c* of the holding cylinder main body 8 comes into contact with the third outer circumferential section 9*c* of the soft seal part 9 from below.

Accordingly, the holding cylinder main body 8 with higher rigidity than the soft seal part 9 supports the application ball 7 via the soft seal part 9 from below. For this reason, the soft seal part 9 can stably support the application ball 7.

Further, the present invention is not limited to the above-mentioned embodiment, and for example, as described below, various modifications of the configuration may be made without departing from the spirit of the present invention.

While the example in which the cap 3 is detachably mounted on the mouth part 1*a* in the above-mentioned embodiment, there is no limitation thereto. In particular, while not shown, for example, the inner plug 2 may have a mounting cylinder section surrounding the mouth part 1*a* from the outer side in the radial direction and extending in the upward/downward direction, and the cap 3 may be detachably mounted on the mounting cylinder section. Alternatively, the cap 3 may be detachably mounted on the drum section 1*c*. That is, the cap 3 is detachably mounted on any portion of the components of the container body 11. Then, the application ball 7 is pushed downward by the cap 3 and pushed into the soft seal part 9 when the cap 3 is mounted on the container body 11.

While the example in which the first locking section 1*d* protrudes outward from the outer circumferential surface of the mouth part 1*a* in the radial direction has been exemplarily described in the above-mentioned embodiment, there is no limitation thereto. For example, the first locking section 1*d* may protrude outward from the outer circumferential surface of the mounting cylinder section of the inner plug 2 in the radial direction, or protrude outward from the outer circumferential surface of the drum section is in the radial direction. That is, the first locking section 1*d* protrudes outward from the container body 11 in the radial direction.

While the example in which the third inner circumferential section 8*c* has the tapered surface shape with the diameter that is gradually reduced downward and the third outer circumferential section 9*c* has the tapered surface shape with the diameter that is reduced downward has been exemplarily described in the above-mentioned embodiment, there is no limitation thereto. For example, the third inner circumferential section 8*c* may be a planar shape that expands in a direction perpendicular to the center axis O directed upward, and the third outer circumferential section 9*c* may be a planar shape that expands in a direction perpendicular to the center axis O directed downward.

In addition, the components of the above-mentioned embodiment may be appropriately substituted with known components without departing from the spirit of the present invention, and further, the above-mentioned embodiment and variants may be combined.

INDUSTRIAL APPLICABILITY

According to the application container of the present invention, it is possible to stably increase seal ability when the cap is mounted.

REFERENCE SIGNS LIST

1 Container main body
1*a* Mouth part
1*d* First locking section
2 Inner plug
3 Cap
3*d* Second locking section
6 Holding cylinder section
6*a* Communication port
7 Application ball
8 Holding cylinder main body
9 Soft seal part
10 Application container
11 Container body
O Center axis

What is claimed is:

1. An application container comprising:

a container main body in which contents are accommodated;

an inner plug mounted on a mouth part of the container main body; and a cap configured to cover the inner plug from above and detachably mounted on a container body including the container main body and the inner plug, wherein the inner plug includes:

a seal cylinder section fitted into the mouth part, a holding cylinder section provided with a communication port configured to bring inside and outside of the container main body in communication with each other, the holding cylinder section disposed inside in a radial direction of the seal cylinder and extending in an upward/downward direction, and an application ball rotatably held in the holding cylinder section and a portion of which is exposed from above through the holding cylinder section, the holding cylinder section includes:

a holding cylinder main body configured to come into contact with the application ball from an outer side and an upper side in a radial direction, and a soft seal part held by the holding cylinder main body, formed of a material softer than the holding cylinder main body, and configured to come into contact with the application ball from below, the soft seal part disposed inside a lower end portion of the holding cylinder main body, the soft seal part has an annular shape extending around a center axis of the holding cylinder main body and is elastically deformable, the application ball is pushed downward by the cap and pushed into the soft seal part as the cap is mounted on the container body, the holding cylinder main body includes:

a first inner circumferential section located at a lowermost side of an inner circumferential surface of the holding cylinder main body, an inner diameter of which is smallest in the holding cylinder main body, a second inner circumferential section located above the first inner circumferential section of the inner circumferential surface of the holding cylinder main body, an inner diameter of which is greater than the inner diameter of the first inner circumferential section, and a third inner circumferential section located between the first inner circumferential section and the second inner circumferential section of the inner circumferential surface of the holding cylinder main body, and connecting an upper end portion of the first inner circumferential section and a lower end portion of the second inner circumferential section, and the soft seal part includes:

a first outer circumferential section, an outer diameter of which is smallest in the soft seal part, and which is in close contact with the first inner circumferential section, a second outer circumferential section, an outer diameter of which is greater than the outer diameter of the first outer circumferential section, and which is in close contact with the second inner circumferential section, a third outer circumferential section located between the first outer circumferential section and the second outer circumferential section of an outer circumferential surface of the soft seal part, and connecting an upper end portion of the first outer circumferential section and a lower end portion of the second outer circumferential section, and a seal protrusion configured to come into contact with a lower end portion of an outer circumferential surface of the application ball from below.

2. The application container according to claim 1, comprising:

a first locking section protruding outward from the container body in the radial direction; and a second locking section protruding inward from an inner circumferential surface of the cap in the radial direction and configured to come into contact with the first locking section to climb over the first locking section from below.

3. The application container according to claim 1, wherein the holding cylinder main body and the soft seal part are formed integrally.

4. The application container according to claim 1, wherein the soft seal part is exposed through a surface of the holding cylinder section directed downward.

5. The application container according to claim 1, wherein the application ball has a spherical shape about the center axis of the holding cylinder main body.

* * * * *